United States Patent [19]

Berzins

[11] 4,136,790

[45] Jan. 30, 1979

[54] CHARGING APPARATUS WITH REMOVABLE BELL

[75] Inventor: Andrejs Berzins, Parma, Ohio

[73] Assignee: Arthur G. McKee & Company, Independence, Ohio

[21] Appl. No.: 845,636

[22] Filed: Oct. 26, 1977

[51] Int. Cl.[2] ..... F27B 11/12

[52] U.S. Cl. ..... 214/36; 29/401 F; 29/426; 214/152

[58] Field of Search ..... 214/35 R, 36, 37, 152; 266/184; 29/401 F, 426

[56] References Cited

U.S. PATENT DOCUMENTS 3,056,518 10/1962 Powell ..... 214/36 X

*Primary Examiner*—Robert G. Sheridan

*Attorney, Agent, or Firm*—Bosworth, Sessions & McCoy

[57] ABSTRACT

Disclosed are apparatus and method according to which a bell in a charging apparatus comprising a bell and surrounding hopper portion may be removed laterally out of the enclosure in which the bell and hopper are located, by removing a closure from an opening in the side of the enclosure that is aligned with bell and hopper portion, temporarily supporting said bell, disconnecting the bell from its bell rod and the hopper portion from its supporting means, and moving the bell and surrounding hopper portion laterally out of the enclosure. A bell and a mating hopper portion may thereafter be moved laterally into the enclosure into positions in which the bell can be connected to its bell rod and the hopper portion to its supporting means, the temporary supporting means is removed and the enclosure is closed.

The disclosed apparatus also includes a lower bell and means for temporarily supporting the lower bell while it is disconnected from its bell rod after which the bell rod for the second bell is moved upwardly where it clears the upper bell, and its hopper so that the temporary supporting means for the upper bell and its hopper portion can be installed and the upper bell and its hopper disconnected to permit their removal.

16 Claims, 8 Drawing Figures

FIG. 2
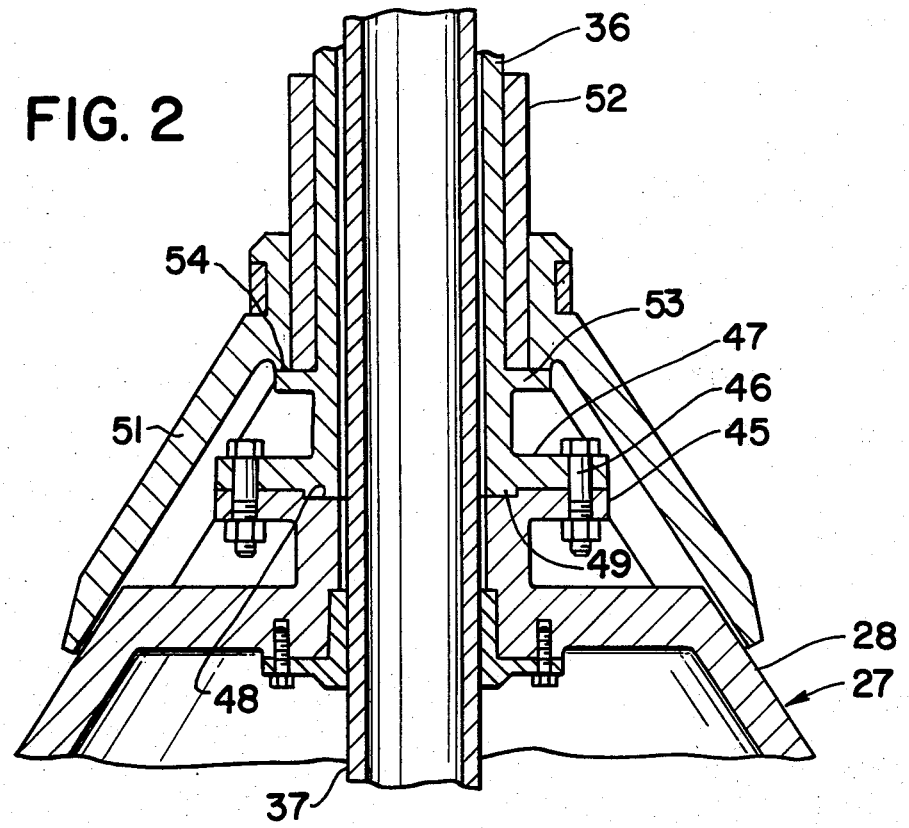
FIG. 3
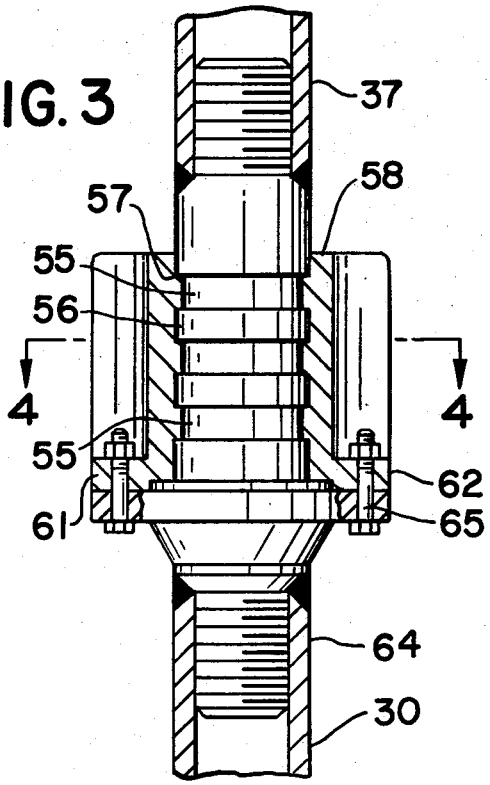
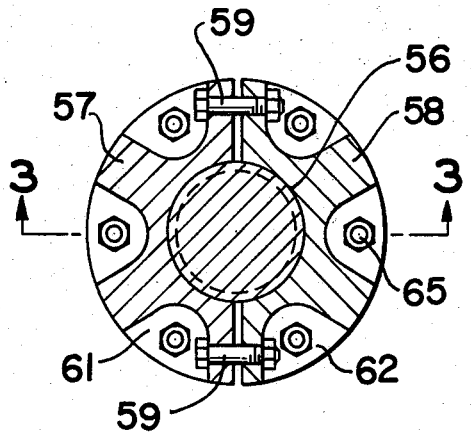
FIG. 4

FIG. 7
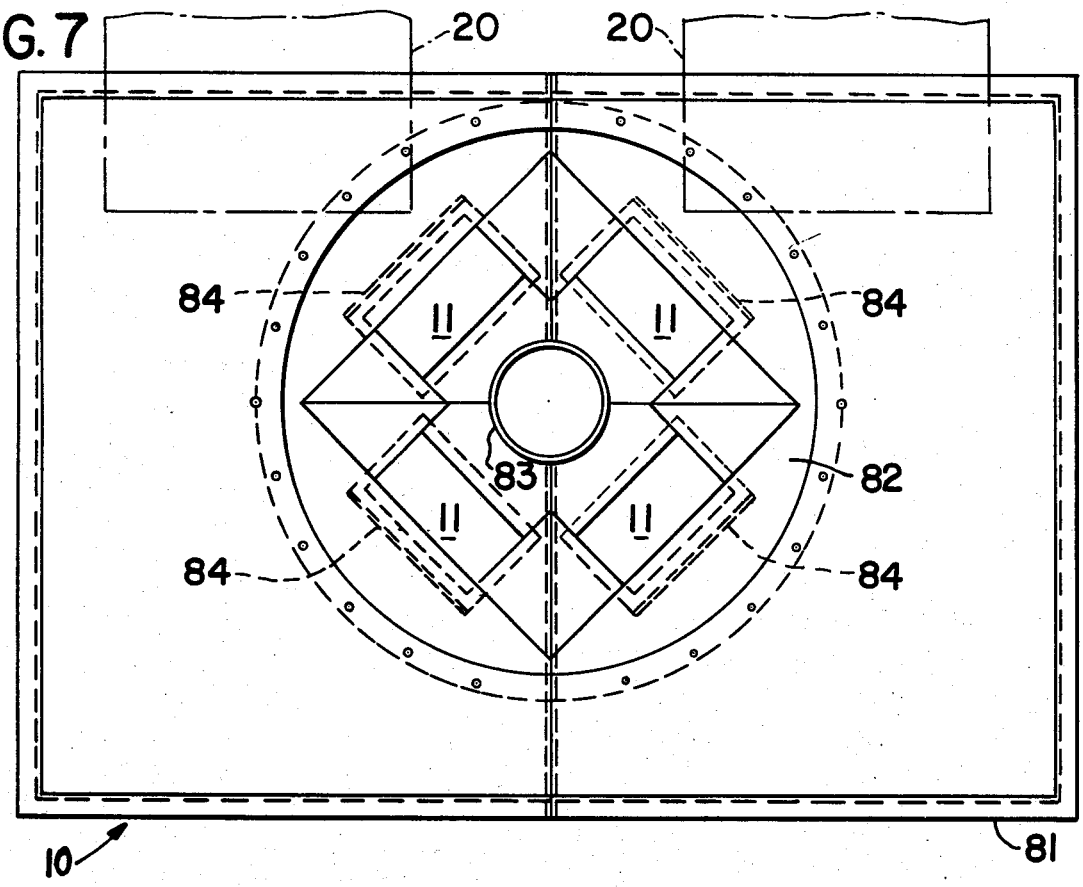
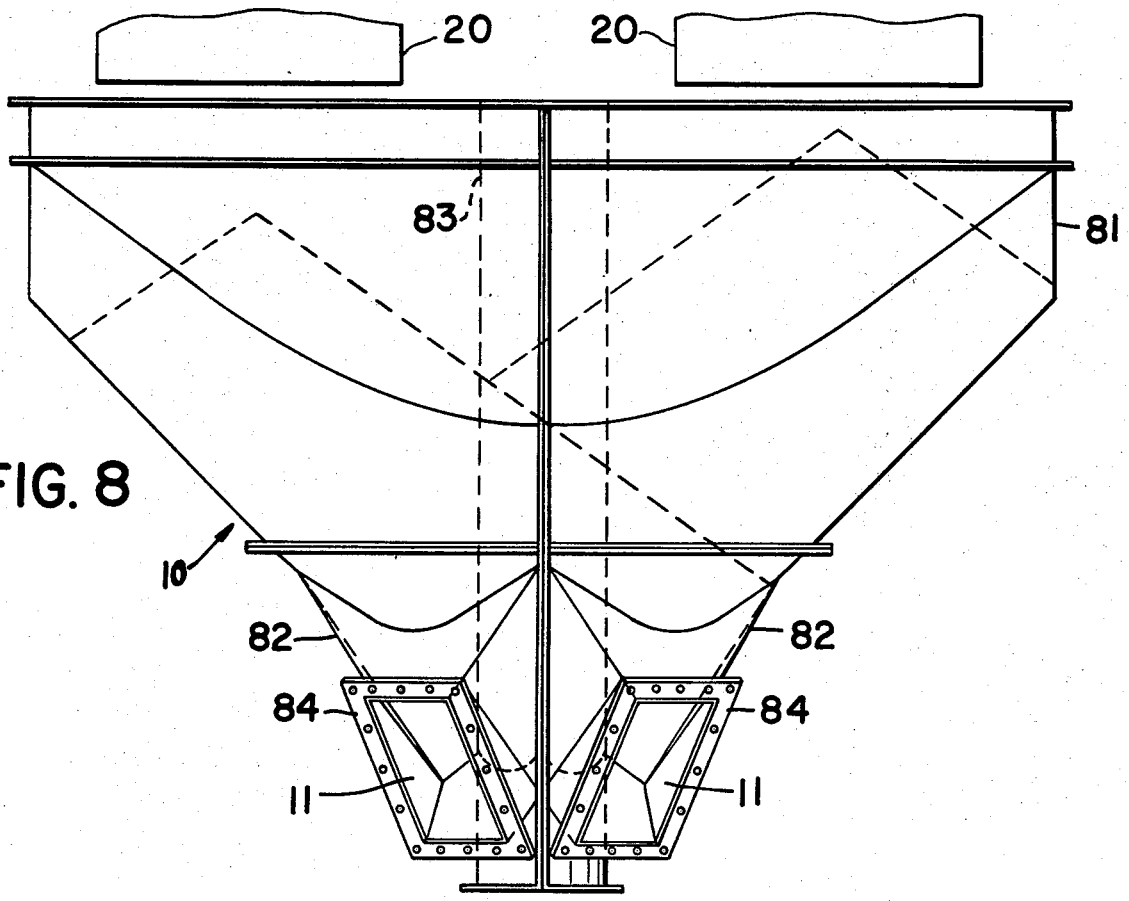
FIG. 8

CHARGING APPARATUS WITH REMOVABLE BELL

DISCLOSURE OF THE INVENTION

1. Field of the Invention

This invention relates to improvements in charging apparatus for receptacles such as blast furnaces, and more particularly to apparatus and method for facilitating rapid and safe removal of a bell and surrounding hopper portion for maintenance, repair or replacement, of such a bell and its surrounding hopper portion without the necessity of dismantling sizable portions of the charging apparatus or other top structure of the receptacle.

For convenience, the invention will be discussed in connection with blast furnaces since it provides exceptional advantages in such receptacles, although the invention may be used in connection with charging apparatus for other types of receptacles.

2. Background of the Invention

Very often the charging apparatus for a blast furnace for charging particulate charge material into the furnace comprises one or more bells movable in an upright path relative to an associated hopper within the furnace, the bell being movable to a position where it can close an opening in the bottom of the hopper and also to a position where it can open the hopper opening to permit discharge from the hopper of charge material that had been introduced into the hopper.

Abrasion and resulting erosion of the surfaces of bells and bell hoppers during the charging operation has been a longstanding problem. The problem has become aggravated because recent furnaces have been designed and constructed for high production, having large stack cross sections and large bell and hopper cross sections, and utilizing substantially increased gas pressures within the furnace, and because in many cases blast furnaces are being charged with beneficiated materials that are more abrasive than materials used in the past. The abrasion and erosion are especially severe at the sealing surfaces of a small bell hopper and small bed in a multiple bell charging apparatus because in general the small bell is moved more often than the large bell between hopper closing and hopper opening positions.

Such abrasion and erosion are increased and substantially more harmful when, as in many furnace charging apparatuses, the bell and hopper act to form a gas seal at the juncture of the opening in the hopper and the surface of the bell when the bell closes the hopper. This usually occurs when the bell and hopper form part of gas lock apparatus that acts to permit introduction of charge material into the furnace while preventing harmful reduction of furnace gas pressure in, or escape of gas from, the furnace. When the bell is in its hopper closing position, the bell and hopper must withstand the pressure of the gas in the furnace. In such case, because the bell and hopper opening are of relatively large diameter, being several feet in diameter, and subjected to varying temperatures, some leakage of furnace gas unavoidably occurs between the bell and hopper when the bell closes the hopper. Such leaked gas contains entrained dust and other abrasive particles that erode the sealing surfaces of the bell and hopper and can cause harmful gas leakage and loss of furnace pressure.

Heretofore, the work involved in maintaining, repairing or replacing an abraded bell and its related hopper portion has been difficult and time consuming because of the arrangement of these parts within the furnace, the heavy weights of the parts, the severe working environment for employees working on the bell and hopper, and usually the necessity of dismantling substantial portions of the furnace top structure. Moreover, such work has made it necessary to cease furnace operations for considerable times, with consequent loss of production.

These problems have been accentuated by the increased abrasion due to the large quantity of charge material that contacts the bell and hopper in large furnaces, the high gas pressures, and abrasive charging materials. Such increased abrasion and resulting erosion has usually necessitated more frequent replacement or repair of the bell and its associated hopper portion than was the case in the past.

These problems are also accentuated by modern furnaces in which there are no revolving distributor hoppers that can be quite readily removed, but there are multiple ports in the top of the furnace through which charge material is selectively discharged, and in which there are often complicated upper portions of the furnace which would require dismantling and removal if it was necessary to remove a bell and hopper upwardly out of the furnace, as has been often done in the past.

Heretofore, blast furnace bells, particularly small bells, usually comprised two halves bolted together to facilitate installation or removal of the bell. In a bell so constructed, a mechanical joint necessarily exists at the sealing surfaces of the bell. This joint is conducive to gas leakage when the bell seals the hopper, particularly since abrasive solid particles entrained in the gas erode and enlarge the joint and accentuate the problem of leakage, abrasion and erosion.

SUMMARY OF THE INVENTION

It is an object of the present invention to provide apparatus that can solve these problems, make possible the use of a bell without such joint between two halves and make possible easy removal of the bell with minimal difficulty or loss of time, and minimal shut-down time for the furnace, and increased safety for workers, and which also makes possible removal of a gas sealing bell and its associated hopper portion so that when they are repaired or replaced the sealing portions of the bell and hopper are properly matched to provide an excellent sealing action.

The invention provides apparatus for charging particulate material into a receptacle, such as a shaft furnace, comprising a housing at the upper portion of the receptacle; a hopper within the housing adapted to receive the particulate material, the hopper comprising a lower hopper portion that is removably fixed to means for aupporting such hopper portion and providing an opening through which particulate material may leave said hopper; a bell movable in an upright path between a hopper closed position in which it substantially, or completely, if desired, closes the hopper opening against discharge or charge material from the hopper and a hopper opened position in which it opens the hopper opening to permit discharge of charge material from the hopper; means for supporting and moving the bell in the upright path; means providing an opening in said housing at a location in lateral alignment with said bell and the lower portion of said hopper when the bell is in hopper closed position, such means including removable closure means adapted to close the enclosure opening; and means permitting the bell to be disconnected from the bell-supporting means to permit lateral movement of the bell and the lower portion of said hopper out of the enclosure through such enclosure opening when such opening means is opened.

The invention also provides means in the furnace or the like adapted temporarily to support means for carrying the bell and the lower hopper portion surrounding the bell after they have been respectively disconnected from the bell supporting means and the hopper supporting means, to permit the bell and lower hopper portion to be moved laterally out of the receptacle through the enclosure opening means after it is opened.

In the more specific embodiments of the invention, the apparatus makes possible the temporary installation of roller conveyor means in the receptacle and outside of the receptacle to carry and transport the bell and its associated lower hopper portion out of the receptacle.

BRIEF DESCRIPTION OF THE DRAWINGS

The above objects, advantages and features of the invention will become more clearly apparent from the following description of a preferred embodiment of the invention in connection with the accompanying drawings in which:

FIG. 2 is a detail, to a scale substantially larger than that of FIG. 1 illustrating how the small bell is rigidly but detachably connected to its bell rod in the apparatus of FIG. 1;

FIG. 3 is a section to a scale larger than that of FIG. 2 and taken along line 3—3 of FIG. 2 illustrating how the large bell of FIG. 1 is detachably connected to its bell rod;

FIG. 4 is a section along line 4—4 of FIG. 3 and to the same scale;

FIG. 7 is a plan to a larger scale than that of FIG. 1, of the stationary external upper hopper itself of FIG. 1; and FIG. 8 is a side view of the hopper of FIG. 7 and to the same scale.

DESCRIPTION OF THE PREFERRED EMBODIMENT

Figure 1:
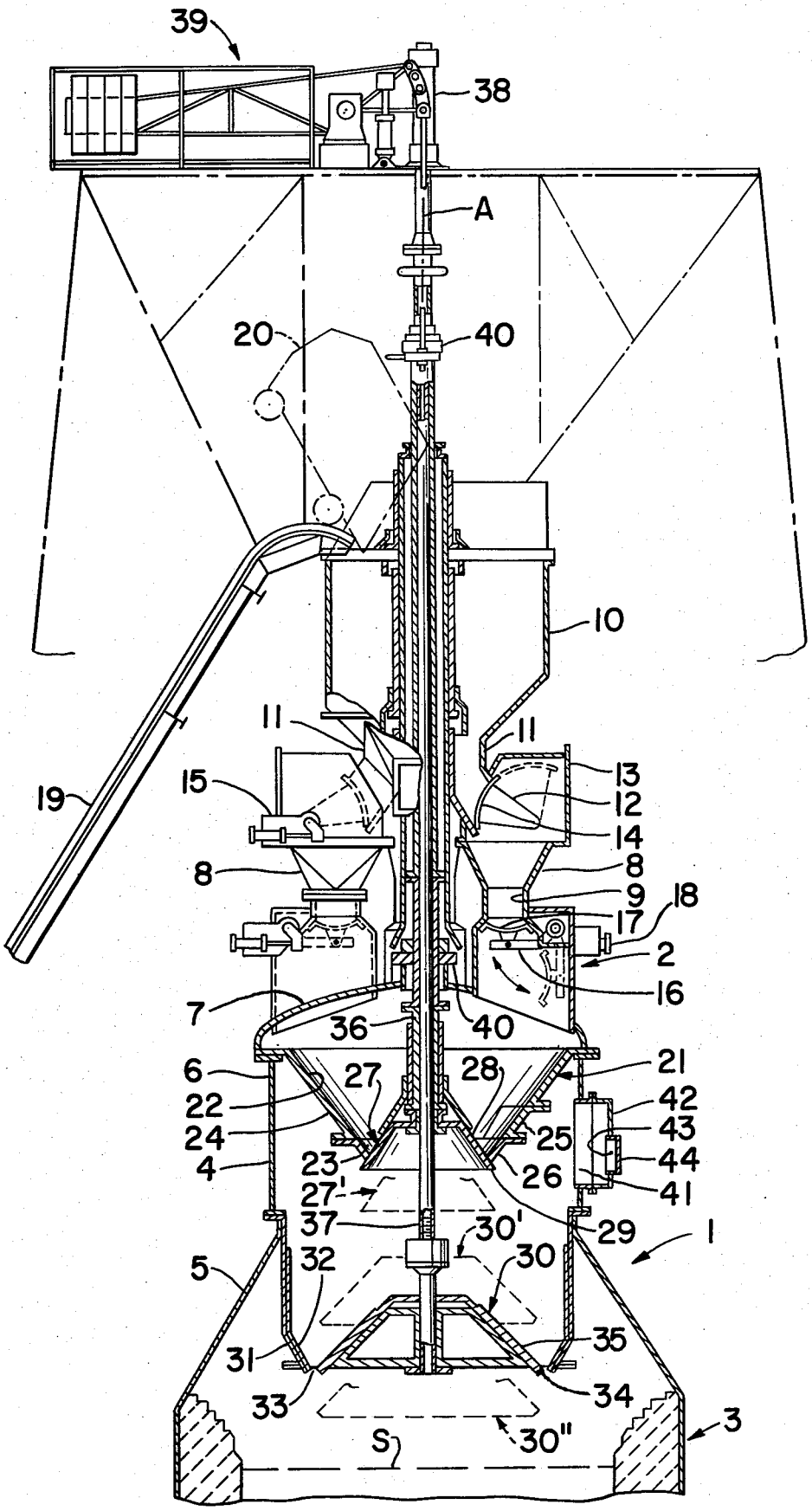
FIG. 1 is a vertical section, to a greatly reduced scale, through the upper portion of a blast furnace embodying the invention.

FIG. 1 discloses a blast furnace 1 comprising a charging apparatus 2 fixed to the stack 3 of the furnace. Charging apparatus 2 comprises an enclosure 4 comprising a lower frustoconical portion 5 generally cylindrical about axis A of the furnace connected gas-tight to an upper portion 6 and having a top portion 7 carrying a plurality, four in the illustrated embodiment, of port means 8 spaced equidistantly and equiangularly about axis A of the furnace. Each port means has a passage 9 through which the port means can discharge particulate charge material into the furnace from a stationary external hopper 10. Hopper 10 has a plurality of downwardly extending individual chutes 11 and adapted to discharge into passage 9 of one of the port means. Between each chute and its passage 9 is a valve means 12 adapted to be closed to prevent, and to be opened to permit, flow of charge material into associated passage 9 and into the furnace. Such material flow controlling valve means comprises a housing 13 between the chute and passage containing a pivotally mounted closure member 14 that can be moved to opened and closed positions by known fluid-operated actuating means 15. Each port means 8 also has gas flow control valve means 16 comprising in the housing of the port means a pivotally mounted closure member 17 that can be moved by known fluid powered actuating means 18 to gas sealing position to close passage 9 and to opened position which opens and clears the flow passage 9 of the port means. Consequently, when the gas valve means of a port means is first opened and then the material flow controlling valve means of such port means is opened, particulate charge material in hopper 10 can discharge downwardly by gravity through passage 9 of the port means into the furnace stack 3.

The illustrated apparatus includes known skip car means comprising a track 19 and a skip car 20 to discharge particulate material into hopper 10.

The illustrated apparatus also includes an upper internal hopper 21 in enclosure 4 connected gas-tight to the enclosure. Hopper 21 has a downwardly inwardly convergent gas impervious inner surface 22 terminating at its bottom in opening 23. This hopper comprises an upper portion 24 having a demountable arcuate closure 25 for a purpose to be described later, and lower hopper portion 26 containing opening 23 rigidly but demountably carried by portion 24 and having an inner surface forming part of surface 23. A bell 27, having a downwardly outwardly divergent upper and outer surface 28 and a lower perimeter 29, is shaped and sized to substantially close opening 23 to prevent discharge of charge material when the bell is raised to the hopper closed position where it preferably contacts the opening in gas sealing relation as shown in full lines in FIG. 1; and to permit charge material to be discharged from hopper 21 through opening 23 when the bell is lowered to the hopper opened position shown in broken lines 27' in FIG. 1. Preferably opening 23 is circular and bell surface 28 is frustoconical.

In the illustrated apparatus, therefore, bell 27 in conjunction with gas valve means 16 forms part of a gas lock system that permits particulate charge material to be introduced into the furnace without harmful loss of gas or gas pressure from the furnace, since when the bell 27 is in its upper hopper closing position, it seals the furnace against escape of gas and thus permits closure member 17 of selected gas valve means 16 to be opened to a position where it clears passage 9, allowing charge material to pass through the passage into hopper 22 when the associated material holding valve means 12 is opened, and permits charge material to be discharged into the stack of the furnace after all gas valve means 16 are closed and bell 27 is then lowered to the hopper opened position.

The illustrated apparatus also includes within enclosure 4 a lower bell 30 that is large compared to upper small bell 27, and a lower hopper 31. Bell 30 and its hopper 31 constitute charge distributor means. Hopper 31 has an inwardly convergent inner surface 32 terminating in a lower opening 33 which in this case is slightly larger than the lower perimeter 34 of bell 30 thus permitting the bell to be raised to upper position 30' shown in broken lines in FIG. 1 in which the bell is within hopper 31, or to be lowered to lower position 31" of FIG. 1 in which the lower portion of the bell is below the hopper opening. The bell has a downwardly divergent upper and outer surface 35. Preferably opening 33 and bell 30 are of circular cross section.

When lower bell 30 is in its upper position, charge material dropped into lower hopper 31 on lowering of upper small bell 27 will drop and strike upper divergent surface 35 of bell 30 and be deflected outwardly to strike the convergent surface 32 of hopper 31 and be deflected by such surface toward the central portion of the furnace stockline S and under the bell.

When lower bell 30 is in its lower position, charge material dropped into lower hopper 32 when upper small bell 27 is lowered, will strike the divergent surface 35 of bell 30 and be deflected toward the outer wall of the furnace. By positioning the lower bell in various intermediate positions, charge material can be deflected to intermediate positions between the central portion and the outer portion of the stockline. Preferably, charge material is discharged from the upper hopper downwardly into the lower hopper while lower bell is moved in its vertical path between its upper and lower positions to achieve a desired distribution of charge material in the furnace and a desired stockline configuration.

By opening of selected ones of port means 8 in a suitable sequence, or simultaneously, desired configurations of the stockline can be achieved; or corrective action can be taken to fill up a stockline in a particular quadrant of the furnace stockline if there should be a depression in that portion of the stockline, by opening of the proper individual port means.

To support and so move the bells, upper small bell 27 and lower large bell 30 are adapted to be raised and lowered as required by a tubular bell rod 36 to which small bell 27 is rigidly connected and bell rod 37 to which bell 30 is rigidly connected and which fits and slides coaxially inside of tubular rod 36, the bell rods being moved up and down as required to actuate the bells by known type of actuating mechanism 38 mounted on framework 39 at the top of the furnace. Suitable sealing means 40 prevents escape of gas past the bell rods.

In the illustrated apparatus, it is apparent that during portions of the charging cycle, small bell 27 and its hopper 21 are in gas sealing relation and must act to prevent harmful escape of gas from the furnace and resist the furnace pressure.

In the operation of a large blast furnace having high gas pressure, as in the one illustrated, there can be channeling by dust-laden furnace gas between sealing surfaces of opening 23 of hopper 21 and the upper surface 28 of bell 27, causing abrasion and eroding of such sealing surfaces. There also can be abrasion of and erosion of these and adjacent surfaces of the bell and lower portion 26 of hopper 21 by abrasive particulate material discharging downwardly from hopper 21 and over the bell 27 when the bell is in its lower hopper-opening position. In time such abrasion and erosion can cause harmful leakage of furnace gas. Severe operating conditions within the furnace can also cause distortion of the surfaces and harmful gas leakage.

According to the present invention, upper internal hopper 21 and its bell 27 are so designed, and bells 27 and 30 are so demountably carried by their bell supporting and actuating means, that bell 27 and the surrounding lower portion 26 of hopper 21 can be simultaneously removed laterally out of the furnace for maintenance, repair or replacement.

For this purpose, furnace enclosure 4 has means in its side defining an opening 41 of sufficient height and width and located in proper alignment to permit lateral, preferably horizontal, movement of bell 27 and lower portion 26 of hopper 21 out of the furnace after opening 41 has been opened by removal of demountable closure means 42 that during furnace operation is demountably fixed in gas tight relation to enclosure 4 to close opening 41. Closure means 42 also has a smaller manhole 43 that is ordinarily closed gas tight by demountable cover means 44 but when opened permits inspection of the condition of bell 27 and hopper 21 without removing larger closure means 42.

Proper means for connecting the bells to their rods are also important to the invention. The means illustrated for demountably securing bell 27 to its bell rod 36 (FIG. 2) comprises a radially extending flanged portion 45 fixed to the top of small bell 27 and spaced from the body of the bell. It is adapted to be demountably connected by bolts 46 to cooperating flange portion 47 fixed to the lower end of bell rod 36, these flanged portions having in one a recess 48 and in the other a projecting boss 49 that interfit to locate the bell accurately with reference to its bell rod. A frustconical shield 51 is slidably mounted on a bearing sleeve 52 on bell rod 36 to shield the bolts and flanges and provide a continuation of the divergent surface of the bell. The shield is supported in its proper lowermost shielding position by another flange 53 spaced above flange 47 on rod 36 to engage a cooperating portion 54 inside of the shield. Shield 46 can be raised on sleeve 52 to provide access to bolts 46 to permit their removal and disconnecting bell 27 from its bell rod when it is desired to remove the bell and to permit reconnecting of a bell 27 to its bell rod when it is desired to install the bell.

Lower large bell 30 is demountably rigidly secured to its bell rod 37 (FIGS. 3 and 4) by means comprising a plurality of radially extending recesses 55 at the lower end of bell rod separated by ridges 56. The recesses and ridges are tightly engaged by matching recesses and ridges on two clamping members 57 and 58 that are rigidly clamped together on rod 37 by bolts 59. These clamping members have lower flange portions 61 and 62 to which a flange 63 on a stub shaft 64 carries bell 30 is rigidly demountably connected by bolts 65. The dimensions of the parts are such that ridges 56 of bell rod 37 are no larger in cross section than the cross section of the bell rod, so that after bolts 65 and 59 and clamping members 57 and 58 are removed from the bell rod 37, the end of the rod can be withdrawn upwardly into tubular bell rod 36 to clear the upper end of the small bell and the upper edge of the lower hopper portion 26 to permit lateral movement of the small bell away from the axis of the bell rods when the small bell and lower hopper portion are disconnected.

During operation of the furnace the lower hopper portion 26 is rigidly demountably fixed gas-tight to upper hopper portion 24, as by bolts. Removable segment 25 is rigidly demountably fixed gas tight to upper hopper portion 24 and can be removed to expose an opening 68 (FIGS. 5, 6) in the side of hopper portion 25 and permit the upper portion of bell 27 to move laterally out of upper hopper portion 24.

Figure 5:
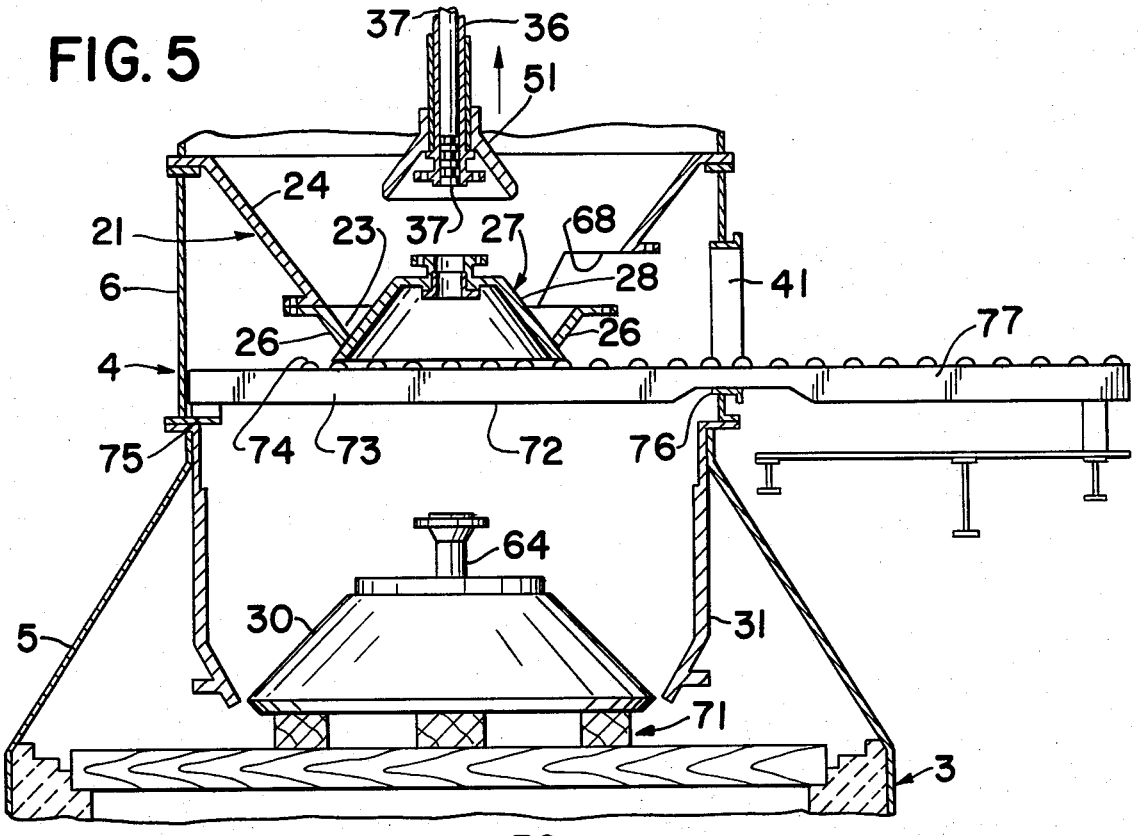
FIG. 5 is a sectional elevation, to a scale larger than that of FIG. 1, of a portion of the blast furnace of FIG. 1, illustrating a step in the removal of a bell and its associated hopper portion, according to the present invention.

When it is desired to remove bell 27 and its associated lower hopper portion 26 of hopper 21 from the furnace, bell 27 is moved to its hopper closed position and closure member 42 of opening 41 in the side of the enclosure 4 is removed, thus providing access to the furnace interior. As shown in FIG. 5, the lower bell 30 is then temporarily supported on suitable known temporary supporting means 71. Clamping members 57 and 58 are disconnected from bell rod 37 and lower bell stub shaft 64, permitting bell rod 37 to be withdrawn upwardly into bell rod 36. In the illustrated embodiment temporary supporting means in the form of roller conveyor member 72 comprising side frames 73 and freely rotatable rollers 74 is then moved into the furnace through opening 41 and mounted on ledge 75 in one side of the furnace and ledge 76 at opening 41 in the other side of the furnace. The relationship of parts is such that the conveyor member 72 can be readily slid under bell 27 when it is in its upper closed position. Preferably, another roller conveyor portion 77 is mounted outside of the furnace to receive the bell and hopper when they are removed. Closure segment 25 of upper portion 24 of the hopper 21 is then removed, thus providing access to the interior of the hopper. Upper bell 27 is then disconnected from its bell rod 36 by raising shield 51 and removing bolts 46. Both bell rods are then raised so that they clear the uppermost portions of lower hopper portion 26 and bell 27. Lower hopper portion 26 is disconnected from upper hopper portion 24 either before or after bell 27 is disconnected from its bell rod and the bell rods raised. The conditions then are as illustrated in FIG. 5.

Figure 6:
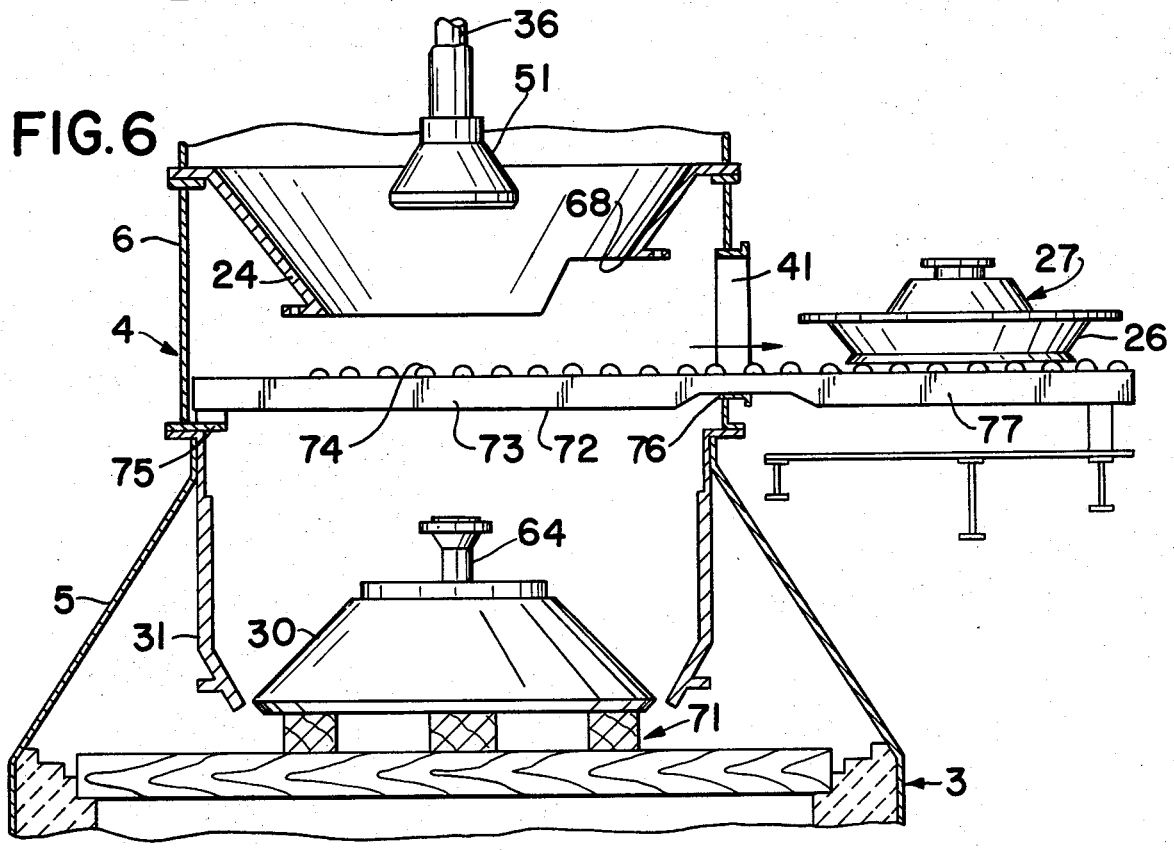
FIG. 6 is a sectional view, similar to that of FIG. 5 and to the same scale, illustrating the bell and hopper portion as removed according to the invention.

Thereafter bell 27 and lower hopper portion 26 surrounding the bell can be moved laterally out of the furnace on roller conveyor members 72 and 77, as shown in FIG. 6.

Bell 27 and hopper portion 26 can then be repaired, or a new bell 27 and lower hopper portion 26 can be provided. In either case it is possible to shape the contacting surfaces of the bell and hopper opening 23 to provide excellent sealing action between the bell 27 and hopper portion 26 after they are installed in the furnace.

The reverse procedure can be followed to assemble the apparatus. The bell and hopper portion are moved into the furnace and aligned with the bell rods as shown in FIG. 5. The upper bell 27 is then rigidly connected to its rod 36, the lower hopper portion 26 is secured to the upper hopper portion 24 and hopper closure segment 25 is secured to both hopper portions 24 and 26. Temporary conveyor member 72 and if desired member 77, are then removed. Bell rod 37 for the bell 31 is then lowered to permit it to be rigidly connected to shaft 64 of the lower bell 30 by the clamping means described previously. Temporary supporting means 71 is then removed through opening 41. Thereafter the closure 42 is demountably fixed to close opening 41 in gas-tight relation, and the furnace is again in condition for operation.

The illustrated external hopper 10, as shown in FIGS. 7 and 8, which depict the hopper itself, comprises an upper portion 81 that is rectangular in plan and tapers downwardly and inwardly to a lower portion 82 having a generally circular cross section at its upper portion and that itself tapers downwardly and inwardly. The hopper has a vertical tubular portion 83 through which the bell rods pass.

The lower portion 82 of the illustrated hopper has four downwardly and outwardly extending chutes 11 having flanges 84 by which each of the chutes is connected to the housing 13 of the associated material holding valve means 12 which controls discharge of charge material into the associated port means 8.

The shape of the upper portion of the hopper is such as to permit discharge of material into the hopper by two skip cars 20, or alternatively by conveyors if desired.

As indicated previously, by suitable control of the material holding valve means 12 and gas valve means 16, particulate charge material can be discharged into the furnace through any one of the port means 8 to achieve a desired stockline configuration and to provide corrective action in achieving a desired stockline configuration if necessary.

Various modifications may be made in the apparatus and method disclosed above. Thus, while the apparatus has been disclosed primarily as used in charging apparatus for blast furnaces, it can be used in connection with charging apparatus for other types of receptacles.

While the invention has been shown as useful in removing and replacing a bell and lower hopper portion that provides a gas sealing function when in the closed position, in which connection it provides outstanding advantages in making possible ready repair or replacement of abraded or eroded bell and hopper portions, it may also be used in removing and replacing bell and hopper portions in which the bell and hopper do not provide gas sealing functions. Furthermore, the invention could be used in removing and replacing the bell itself by suitable design of the hopper to have an openable side portion sufficiently large to permit removal of the bell itself; this could be particularly useful if the hopper and the bell do not provide a gas sealing function.

While the invention has been disclosed in connection with a blast furnace having a particular type of external hopper and port means for introducing material into the furnace, it could be used in connection with a type of apparatus widely used heretofore having a small bell and a large bell each of which performs a gas sealing function, in which case apparatus embodying the invention could, if desired, be made permitting removal of either or both of the bells and its cooperating hopper portion laterally out of the furnace.

From the above it is apparent that the apparatus and method of the present invention overcome all of the disadvantages heretofore indicated, by making possible simple and rapid removal of a bell and its associated cooperating hopper portion laterally out of the furnace without the need for extensive dismantling of any portion of the furnace and particularly any portion of the furnace above the bell, and by making possible the ready insertion and installation in the furnace of a bell and cooperating hopper portion having configurations that match closely, which is particularly advantageous if the bell and hopper are to perform a gas sealing function.

Various modifications in addition to those indicated above will be apparent to those skilled in the art and may be made in the apparatus disclosed above, and changes other than those indicated may be made with respect to the features disclosed, provided that the elements set forth in the following claims or the equivalents of such be employed.

What is claimed is:

1. Apparatus for charging particulate material into a receptacle comprising a housing at the upper portion of said receptacle; a hopper within said housing adapted to receive particulate material, said hopper comprising a lower hopper portion removably fixed to means for supporting said hopper portion and providing an opening in said hopper portion through which particulate material may leave said hopper; a bell movable in an upright path between a hopper closing position in which it substantially closes said opening against discharge of charge material from said hopper and a hopper opening position in which it opens said opening to permit discharge of charge material from said hopper; means for supporting and moving said bell in said upright path; means providing an opening in said housing at a location in lateral alignment with said bell and said lower portion of said hopper when said bell is in said hopper closing position, said means including removable closure means adapted to close said opening in gas tight relation; and means permitting said bell to be disconnected from said bell-supporting means to permit lateral movement of said bell and said lower portion of said hopper out of said enclosure through said enclosure opening means when said enclosure opening means is opened.

2. The apparatus of claim 1 comprising means in said receptacle adapted temporarily to support means for carrying said bell and said lower hopper portion after they are respectively disconnected from said bell-supporting means and said supporting means for hopper portion and permitting said bell and said hopper portion to be moved laterally out of said receptacle through said enclosure opening means after it is opened.

3. The apparatus of claim 2 comprising means outside of said receptacle adapted to receive said bell and said hopper portion after they have been moved laterally of of the receptacle.

4. The apparatus of claim 2 in which said means for carrying said bell and said hopper portion comprises a roller conveyor.

5. The apparatus of claim 3 in which said means outside of said furnace comprises a roller conveyor.

6. The apparatus of claim 1 in which said bell and said hopper portion are adapted when said bell is in said hopper closing position to form a gas seal at the juncture of said bell and hopper portion.

7. The apparatus of claim 1 in which said bell is a first bell in said receptacle and in which there is a second bell below said first bell and movable in an upright path; first bell rod means supporting said first bell for movement in its upright path; second bell rod means coaxial with said first bell rod means for supporting said second bell for movement in its upright path; means for disconnectably connecting said first bell to said first bell rod means; and means for disconnectably connecting said second bell to said second bell rod means so that after said second bell is disconnected from said second bell rod means, said second bell rod means may be drawn upwardly sufficiently to clear said first bell and to permit lateral movement of said first bell out of said furnace enclosure after said first bell is disconnected from its first bell rod means and after said hopper portion is disconnected from its supporting means.

8. The apparatus of claim 1 in which said lower hopper portion is of lesser height than the height of said bell at the location where said bell is connected to its bell supporting means; in which said lower hopper portion supporting means is an upper hopper portion to which said lower hopper portion is demountably connected; and in which said upper hopper portion has a recess in the side thereof facing said housing opening means that permits the upper portion of said bell that projects above said lower hopper portion to pass laterally out of said upper hopper portion after said bell and said lower hopper portion are respectively disconnected from said bell supporting means and said upper hopper portion, said recess in said hopper portion being adapted to be closed by removable closure means after said bell and said hopper lip portion are in place in said furnace and located where they are respectively connected to said bell support means and said upper hopper portion.

9. The apparatus of claim 1 comprising port means above said hopper in the top of said enclosure to permit particulate material to be deposited in said enclosure, and gas sealing means to close said port means; and in which apparatus said lower portion of said hopper and said bell are sized and shaped to provide a gas seal when said bell is in its hopper-closing position, whereby said bell and said hopper and said gas sealing means for said port means form a gas lock permitting charging of particulate material into said furnace without harmful loss of gas pressure.

10. The apparatus of claim 9 in which there are a plurality of said port means each with a gas sealing means at the top of said enclosure, and in which there is chute means adapted to discharge particulate material into a selected one of said port means when its gas sealing means is open.

11. The apparatus of claim 10 comprising a stationary hopper above said port means, said hopper having a plurality of chutes each adapted to discharge into one of said port means, and in which there are material holding valve means adapted individually to close and open each of said chutes as desired to discharge material from said upper hopper means into said enclosure through a selected one of said port means when its gas sealing means is open.

12. The method of changing a bell and associated hopper portion in a charging apparatus that includes an enclosure in which the bell is movable in an upright path relative to a hopper portion having an opening between a bell position in which the bell is spaced from said opening to permit charge material to pass out of said hopper portion and a position in which the bell substantially closes said hopper portion, and in which the bell is supported and so moved by a bell rod, which method comprises forming an opening at a side location in which said opening is substantially aligned with said bell and said hopper portion when said bell is in said hopper closing position, placing temporary supporting means to temporarily suport said bell and said hopper portion in said enclosure while said hopper portion surrounds said bell; disconnecting said bell from its bell rod and said hopper portion from its supporting means, and moving said bell and said hopper portion laterally out of said enclosure through the said opening.

13. The method of claim 12 in which in said apparatus said bell is a first bell and said apparatus and said first bell is supported and moved in said upright path by a first bell rod and in which said apparatus includes a second bell below said first bell supported by a second bell rod coaxial with said first bell rod, which method comprises placing supporting means to temporarily support said second bell, disconnecting said second bell from its bell rod, raising the resulting free end of said second bell rod above the lower edges of said first bell and said hopper portion, and thereafter temporarily supporting said first bell and its surrounding hopper portion from their lower edges before disconnecting said first bell from its bell rod and said hopper portion from its supporting means, then disconnecting said first bell from its bell rod and said hopper portion from its supporting means, and moving said first bell and its surrounding hopper portion laterally out of said enclosure through said opening after the free ends of both said bell rods are positioned above the hopper portion of said disconnected first bell and hopper portion.

14. The method of claim 12 in which a bell and mating surrounding hopper portion are thereafter moved laterally into said enclosure through said opening and positioned so said bell is aligned with its bell rod and said hopper portion is aligned with its supporting means, connecting said bell to its bell rod and said hopper portion to its supporting means, removing said temporary supporting means, and closing said opening said enclosure.

15. The method of claim 13 including the steps of moving a first bell and mating surrounding hopper portion laterally into said enclosure through said opening while it is opened and positioning said bell and hopper portion so said bell is aligned with its bell rod and said hopper portion is aligned with its supporting means, connecting said first bell to its bell rod and said hopper portion to its supporting means, removing said temporary supporting means for said first bell and its surrounding hopper portion, lowering said second bell rod for said second bell to a position where it can be connected to said second bell, connecting said second bell to said second bell rod, removing said temporary supporting means for said second bell, and closing said opening in said enclosure.

16. Apparatus for charging particulate material into a receptacle comprising a housing at the upper portion of said receptacle; a bell movable in an upright path between a hopper closed position in which it substantially closes a hopper in said housing against discharge of charge material from said hopper and a hopper opened position in which it opens said hopper to permit discharge of charge material from said hopper; means for supporting and moving said bell in said upright path; means providing an opening in said housing at a location in lateral alignment with said bell when said bell is in a predetermined position, said means including removable closure means adapted to close said opening in gas tight relation; means permitting said bell to be disconnected from said bell-supporting means; and means in said receptacle permitting said bell to be temporarily supported and moved laterally out of said housing through said housing opening means after said bell has been disconnected and after said housing opening means has been opened.

* * * * *